US008323730B2

(12) United States Patent
Brune et al.

(10) Patent No.: US 8,323,730 B2
(45) Date of Patent: Dec. 4, 2012

(54) METHOD AND DEVICE FOR APPLYING ADHESIVE THERADS AND POINTS TO A SUBSTRATE, WEB OF MATERIAL COMPRISING A FLEECE AND A LAYER COMPOSED OF ADHESIVE THREADS, AND PRODUCTS MADE THEREFROM

(75) Inventors: Michael Brune, Monheim am Rhein (DE); Josef Rothen, Solingen (DE)

(73) Assignee: Illinois Tools Works, Inc., Glenview, IL (US)

( * ) Notice: Subject to any disclaimer, the term of this patent is extended or adjusted under 35 U.S.C. 154(b) by 1259 days.

(21) Appl. No.: 11/992,636

(22) PCT Filed: Sep. 25, 2006

(86) PCT No.: PCT/EP2006/009281

§ 371 (c)(1), (2), (4) Date: Apr. 24, 2008

(87) PCT Pub. No.: WO2007/036338

PCT Pub. Date: Apr. 5, 2007

(65) Prior Publication Data

US 2009/0136660 A1 May 28, 2009

(30) Foreign Application Priority Data

Sep. 27, 2005 (DE) ..... 20 2005 015 267 U
Apr. 6, 2006 (DE) ..... 10 2006 016 584

(51) Int. Cl.
*B05D 5/10* (2006.01)

(52) U.S. Cl. ..... 427/208.6; 427/207.1; 427/208.2; 427/208.4

(58) Field of Classification Search ..... 427/207.1, 427/208.2, 208.4, 208.6
See application file for complete search history.

(56) References Cited

U.S. PATENT DOCUMENTS 3,856,012 A * 12/1974 MacDonald et al. ..... 604/366
(Continued)

FOREIGN PATENT DOCUMENTS

DE 22 00 782 8/1973
(Continued)

OTHER PUBLICATIONS

International Preliminary Report on Patentability and Written Opinion of the International Searching Authority dated Apr. 24, 2008 in connection with International Appln. No. PCT/EP2006/009281, filed Sep. 25, 2006.

(Continued)

*Primary Examiner* — Michael Cleveland
*Assistant Examiner* — Xiao Zhao
(74) *Attorney, Agent, or Firm* — Rankin, Hill & Clark LLP

(57) ABSTRACT

The invention relates to a device for applying adhesive threads to a substrate (30). Said device comprises an rotatable application head (18) encompassing at least one adhesive discharge nozzle (18A) located at a radial distance (b) from the axis of rotation (18D) of the application head (18), a shaft (18B), and at least one adhesive supply duct (18C) which extends from an adhesive supply unit (20) to the at least one adhesive discharge nozzle (18A) via the shaft (18B). A rotary drive unit (12, 15, 14) rotates the application head (18) about the shaft (18B) thereof while an adhesive supply unit (20) and/or a valve assembly (22) control/s impingement of the adhesive supply duct (18C) of the application head (18) with adhesive. The invention further relates to a method for applying adhesive threads to a substrate as well as products made therefrom.

21 Claims, 6 Drawing Sheets

Figure 1:
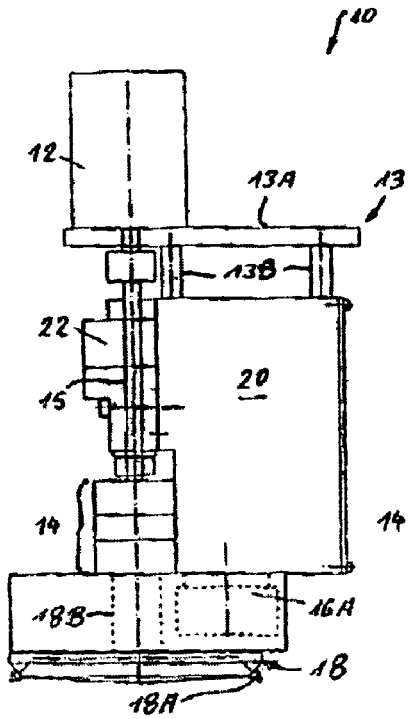

Key: 1 Adhesive outlet
2 Plate nozzle with 4-8 nozzles
3 Adhesive application

U.S. PATENT DOCUMENTS

| | | | | |
|---|---|---|---|---|
| 4,163,305 | A | 8/1979 | Semjonow et al. | |
| 4,898,634 | A | 2/1990 | Keuchel | |
| 5,244,724 | A | 9/1993 | Antonacci et al. | |
| 5,312,500 | A | 5/1994 | Kurihara et al. | |
| 5,582,865 | A | 12/1996 | Rezuke et al. | |
| 5,652,048 | A | 7/1997 | Haynes et al. | |
| 6,240,674 | B1 | 6/2001 | Otake et al. | |
| 2003/0114067 | A1 * | 6/2003 | Matela et al. | 442/365 |
| 2004/0126579 | A1 | 7/2004 | Creagan | |
| 2005/0136189 | A1 * | 6/2005 | Blincoe et al. | 427/421.1 |

FOREIGN PATENT DOCUMENTS

| | | |
|---|---|---|
| DE | 22 60 135 | 6/1974 |
| DE | 23 02 928 | 7/1974 |
| DE | 196 45 195 | 5/1998 |
| EP | 0 340 542 | 11/1989 |
| EP | 0 413 251 | 2/1991 |
| EP | 0 414 917 | 3/1991 |
| EP | 0 453 819 | 10/1991 |
| EP | 0 867 551 | 9/1998 |
| EP | 1 277 868 | 1/2003 |
| FR | 2 400 833 | 3/1979 |
| FR | 2 847 178 | 5/2004 |
| GB | 2 094 809 | 9/1982 |
| GB | 2 252 047 | 7/1992 |
| GB | 2 300 806 | 11/1996 |
| GB | 2 376 402 | 12/2002 |
| WO | WO 2005/075747 | 8/2005 |

OTHER PUBLICATIONS

International Search Report for PCT/EP2006/009281, Jun. 15, 2007.

* cited by examiner

Key: 1 Cylindrical nozzle with a borehole
2 Adhesive outlet
3 Spiral-shaped adhesive application Key: 1 Cylindrical nozzle with two boreholes
2 Adhesive outlet
3 Spiral-shaped adhesive application Key: 1 Cylindrical nozzle with four boreholes
2 Adhesive outlet
3 Spiral-shaped adhesive application Key: 1 Adhesive outlet
2 Plate nozzle with 4-8 nozzles
3 Adhesive application

METHOD AND DEVICE FOR APPLYING ADHESIVE THERADS AND POINTS TO A SUBSTRATE, WEB OF MATERIAL COMPRISING A FLEECE AND A LAYER COMPOSED OF ADHESIVE THREADS, AND PRODUCTS MADE THEREFROM

This application claims priority to and the benefit of the filing date of International Application No. PCT/EP2006/009281, filed Sep. 25, 2006, which application claims priority to and the benefit of the filing date of German Application No. 20 2005 015267.6, filed Sep. 27, 2005 and German Application No. 10

TECHNOLOGICAL BACKGROUND

The invention relates to a method and to a device for applying adhesive threads onto a substrate. It also relates to a material web comprising an adhesive-thread fleece and an adhesive-thread layer. It also relates to products made from this web. It is used in a plurality of technical fields, e.g., in fixing powdery substances onto a base, such as a filter paper or filter cloth, in stone-wool coating, in hygienic products, such as diapers and sanitary napkins, in textile lamination, in carpet coatings, as anti-slip application, in paper bonding, such as paper towels, toilet paper, or paper napkins, and many more.

It is known to make fine and very fine adhesive threads in such a way that the liquid adhesive, for a hot melt bonding agent the fusible adhesive, is pressed through a nozzle duct. At the outlet of the still relatively large caliber adhesive thread, an extension in the longitudinal direction and swirling of the adhesive thread occur in such a way that the adhesive thread emerging from the nozzle is gripped by an air vortex by means of suitably arranged air-guidance ducts. The air nozzles are directed so that the thread performs an approximately spiral-shaped movement. The strand formed in this way is deflected by a spray application onto the substrate to be overlaid with an adhesive thread pattern. Through the use of air, the adhesive thread is cooled on its path between the nozzle and substrate. Therefore, the air must be greatly heated, which requires a lot of energy for a large surface-area adhesive application and is expensive. And only small heating of the adhesive thread, as a rule, has an effect only on a part of its flight path, so that the adhesive thread may already be noticeably cooled when it strikes the substrate. The spraying air, which likewise has a directional component toward the substrate, must be deflected back when striking the substrate if the substrate is not sufficiently permeable to air. Therefore, a kind of air cushion is created above the substrate, which supports the very light, drawn-out adhesive thread when it sinks onto the substrate, so that the thread can be only placed on the substrate where this air-cushion effect is sufficiently weak, thus, in the edge zones. Another disadvantage of the air spraying system (other gaseous media can also be used instead of air) is that very small application weights per substrate surface area of, e.g., one to five grams per $m^2$ are barely possible. The fineness of the meshwork of the adhesive threads deposited onto the substrate is also relatively coarse because the adhesive threads always overlap in the edge region. In a spray application, this leads to the formation of strips and an excess of adhesive in the edge region of the adhesive application.

PRESENTATION OF THE INVENTION

The invention is based on the task of improving the application of adhesive threads onto a substrate to the extent that an improved application is achieved without the use of spraying air, as well as the use of such an application for new or improved web-like products, as well as an adhesive thread according to claim 18 or an adhesive thread layer or a material web comprising this layer according to claim 19.

For achieving this task, a device is proposed with the features of claim 1, and a method is proposed with the features of claim 15. Accordingly, the invention is based on letting one or more adhesive application nozzles rotate on a rotating path, so that centrifugal forces that can be set selectively without applying disruptive spraying air act on the emerging adhesive thread and thus allowing the production of an adhesive thread pattern that can be set relatively exactly on the substrate. Starting with this technical concept, it is now possible in many ways to selectively vary the adhesive application onto the substrate. Essential parameters of this variation are: the rotational speed of the application head, the outlet pressure in the application head, the nozzle cross section, the number of nozzles on the application head, the ejection angle between the rotational axis of the outlet head and the nozzle axis, the radial distance of the opening of the outlet nozzle from the rotational axis, the axial length of the adhesive supply duct between the adhesive charging valve and the axial position of the adhesive outlet nozzle, and also material parameters of the adhesive, including its viscosity, its melting point, and the adhesive temperature in the region of the outlet nozzle. Accordingly, the stretching possibilities of an adhesive thread also depend on the properties of the adhesive, which influence, among other things, the inner cohesion of the adhesive thread. If the latter is very low, the adhesive thread rips apart into more or less short sections, which can also obtain point-like shapes. For the purpose of this invention, the stringing together of such thread sections is also understood as "adhesive threads."

Preferred pressures on the adhesive in the region of the adhesive supply unit or the adhesive supply duct lie between approximately 10 and 200 bar, especially preferred between 25 and 180 bar.

Increasing the rotational speed of the application head increases the application diameter and influences the applied weight per area of the adhesive. The latter is also dependent on the relative velocity between the rotating application head and the substrate in the radial direction relative to the rotational axis. The higher the relative velocity, the smaller the weight per area and the coarser the thread pattern. Incidentally, through a relatively higher rotational speed, the adhesive thread, after emerging from the outlet nozzle, is stretched increasingly strongly. Therefore, the individual thread can obtain a very small diameter and, consequently, includes less adhesive mass. An especially fine adhesive distribution is possible, despite low or moderate weight per area. Typical rotational speeds of the application head lie between 100 and 10,000 revolutions per minute. A preferred rotational speed range lies between 400 and approximately 5000 revolutions per minute.

The cross sections of the one or more adhesive supply ducts in the application head are selected as large as possible when the greatest possible centrifugal forces are desired. These forces increase when the moving mass of the adhesive in the adhesive supply duct becomes larger.

Preferred nozzle cross sections lie between approximately 0.2 and 2.0 millimeters. The smaller the nozzle cross section, the greater the material pressure. The variability of the viscosity, e.g., due to different temperatures, is relatively small. Accordingly, smaller calibrated nozzles lead to larger applied weights due to the higher necessary pressure. For larger nozzle cross sections, a smaller material pressure is required.

In this way, one achieves the unexpected effect that a large nozzle (for example, with a diameter of 1 millimeter) leads to very good thread stretching and, in this way, a low thread weight per unit of thread length is achieved. Lower pressures also mean lower operating costs. For smaller nozzles, the stretchability is smaller. Therefore, the application width for the smaller nozzles with the correspondingly higher pressure is greater than for the larger nozzles with smaller pressures. If several nozzles with different apertures are arranged at the same circumference of the application head, this leads to a thread pattern with different application widths of the adhesive threads originating from the different nozzles.

If at least the application head, and possibly also its peripheral devices, is/are heated, the flow characteristics of the adhesive in the adhesive supply duct can be influenced. Of special advantage is a no-contact heating of the sections of the adhesive supply duct leading directly to the adhesive outlet nozzles. For this purpose, e.g., infrared emitters can be used, which do not necessarily have to rotate with the application head. For rotatable application heads with a plate shape, that are preferred according to the invention, the reverse side of the plate offers a good possibility of allowing considerable amounts of heat to act on the adhesive in the adhesive supply duct. In this way, a strongly heated emitter can heat the rotating part of the application head without physical contact with this rotating part of the application head. An air gap remaining between this heating element and the rotating part of the application head can be kept free from contaminants through active blowing of a fluid, such as air.

To obtain a web-shaped material application made from adhesive threads in layer form, the application head moves relative to a base. Preferably, the application head remains in a given position and an endless belt, which runs underneath this head at a distance and which is guided between two deflection rollers, takes up the adhesive thread layer and transports it to a transfer point. Here, it is possible to let a web-shaped substrate travel progressively with the transport belt or another transport device for web-shaped material under the application head, so that the material web is used as a substrate for the adhesive thread layer and, consequently, a multiple-layer material web is produced, on whose top side the adhesive thread layer is located. However, it is also possible to use the transport belt itself as a substrate and to apply onto this substrate only the adhesive thread layer. If the surface of the transport belt facing the adhesive is made from an appropriate material, such as a PE layer, then the adhesive thread layer surprisingly can be lifted from the transport belt after a cooling section and handled as a standalone adhesive thread fleece, e.g., wound up or processed further. In both cases, the adhesive thread layer is more or less porous, wherein the porosity and also the application pattern can be set with the help of process parameters and the shape of the application head. The transport belt also has the function of defining a cooling section for the adhesive thread layer or the adhesive thread fleece. This can be realized with and without active cooling. The grammage can be set within very wide limits, wherein 1 gram per $m^2$ corresponds to a fleece thickness of approximately 1 μm.

By means of the invention, it is achieved, among other things, that the application edges of the adhesive are relatively sharp and are relatively well supplied with adhesive, because the threads lie one above the other parallel or approximately parallel to the work direction (direction of relative motion between the substrate and application head). This can lead in certain cases to a certain amount of excess supply of adhesive at the web edges. Such an excess supply can be avoided, for example, if several nozzles are provided on the application head and the arrangement of these nozzles differs from one to another in such a way that a part of the nozzles leads to a different adhesive application width (in comparison with the other nozzles). This is achieved, e.g., through different radial distances of the individual nozzles from the rotational axis and/or different axial positions of the outlet nozzles with respect to the shaft shank. In this way, a separate application image is achieved by each nozzle with a different arrangement. Therefore, if the application width of the individual application images varies, then the excess supply of all of the substrate strips provided with adhesive threads is reduced. Also the ejection angle can be used for this purpose. This can also equal, in principle, 0°, i.e., the axis of the outlet nozzle runs parallel to the rotational axis. Even negative ejection angles are possible, i.e., the nozzle axis is directed back toward the rotational axis. In such cases, however, the relatively large centrifugal forces acting on the emerging adhesive thread lead to the result that the adhesive thread can rip. Therefore, the ejection angles preferably equal 15° and more radially outward. Large ejection angles of, e.g., 90°, are also possible. However, then the application images at the edges are less sharp.

Plate-shaped or disk-shaped application heads have proven especially useful. This is because, among other things, they generate relatively little air movement, which could influence the thread flight. Nozzles sunk into the application head also promote this goal.

Through the relatively simple adjustability of the operating parameters of the application device, it is also possible to change the application image during the adhesive application, in particular, to change the application width. This is realized especially by changing the pressure acting on the adhesive and/or changing the rotational speed of the application head. In this way, non motion-parallel application contours are realized.

By means of the invention, completely new products can be produced, namely a plastic thread fleece, with numerous possible applications, as well as improved multiple-layer material webs, wherein one of the material webs is the adhesive thread layer. The following products can be produced with the invention, among other things, in new or especially advantageous ways.

A fleece made from adhesive threads (adhesive thread fleece), which can be produced with a given width, grammage, permeability/porosity, adhesive properties, and pattern formation. Here it involves a completely novel, standalone, workable product.

As an alternative, such a fleece can be covered with fine-particle material, such as activated charcoal filter particles, super-absorber particles, grains, and other particles, before cooling/hardening, so that these fine particles adhere to the adhesive threads, and a defined surface loading is achieved with the fine particles. Such an adhesive thread fleece can be further processed to form a multiple-layer material, e.g., under heat treatment, arbitrary surfaces can also be adhered or laminated in arbitrary surface shapes. Naturally, it is also possible to cover the substrate, on which the fine particles are to be fixed in a distributed way, with the adhesive thread layer, and to cover the fine particles simultaneously or shortly thereafter, as long as the adhesive is still able to bond. The resulting, at least three-layer web product can also be compressed carefully in known roller arrangements in order to work the adhesive thread layer deeper into the substrate and the fine particles deeper into the adhesive thread layer or the substrate. In this way, e.g., a thin film, e.g., made from polyester, which is permeable to air, can be provided with the adhesive thread layer on the top side and then powdered with activated charcoal or super-absorber dust. Such materials can be used advantageously in air filters, wherein an uncommonly large uniformity of the activated charcoal coating is achieved.

The adhesive thread layer can be used in the field of textile bonding as an adhesive intermediate layer, e.g., for the bonding of textile with textile, textile with a membrane, e.g., a water-tight or vapor-permeable membrane, like those that can be used in the clothing industry, including the shoe industry, or also in the automotive industry, to name only a few examples. Because the method is barely limited with respect to usable adhesives, wash-resistant textile adhesives can also be used. These can be washed up to 90° C. these days.

Another field of application is so-called super-absorbers, which can be used for hospital bed underlayers, sanitary napkins, diapers, inserts in protective clothing, absorbent cushions for packages of moisture-sensitive parts, absorbent fleece for boxes or cardboard packages, e.g., for linings, for packages of moisture-sensitive parts, absorbent fleece for dehumidification of basements or rooms, among other things, in new construction or after flooding, or also as roofing underlays. Material webs for such products are made at least from an adhesive thread fleece, especially from a hot-melt adhesive and a fine-particle coating, which is especially well suited for the corresponding field of application. Through heat activation, the hot-melt fleece can bond at a later time, after it has been moved exactly into position.

An adhesive thread fleece, especially made from hot-melt adhesive, can be used coated with fine-particle activated charcoal for protective clothing, breathing protection, in the form of protective shoe inserts as odor filters, and in many other applications of absorption technology. If the application in the scope of lamination relates, in particular, to press lamination of blanks for components of motor vehicle interiors, such as the production of roof linings, door linings, decorative strips, dashboards, or the like, a polyurethane hot-melt adhesive (Pur-Hot-melt) can be used as the adhesive thread fleece. These adhesives can also be activated by heat and thus permit an exact positioning and subsequent bonding of such blanks.

Floor step insulating mats, like those, e.g., under hard floor coverings, that can be used as so-called laminate floors, represent another embodiment of material webs according to the invention, wherein the substrate for the application of an adhesive thread layer can be a group of suitable fibers, e.g., mineral fibers.

Another embodiment of material webs according to the invention is a film with an anti-slip coating on at least one side of the film. Plastic films are used increasingly for protecting goods stored in the open, such as freshly cut wood, tarps for transporting goods, and the like. Therefore, these are normally exposed to occasional moisture, e.g., raindrops. If such film-covered goods can be walked on, there is a high risk of slipping. By means of the invention, the film surface, a pattern of adhesive threads of suitable density and arrangement, is applied onto one side of the film in a bonding way, so that after the adhesive bonds with the substrate and the adhesive hardens, a certain anti-slip effect is achieved. This can be adapted through suitable adhesive selection to the application.

Another embodiment of material webs according to the invention is decorative materials or decorative fleece. For this purpose, either a decorative material is used as the substrate, or an adhesive thread fleece itself represents the decorating hanging. In both cases, an adhesive is provided with, e.g., optical brighteners, such as UV indicators. With corresponding illumination of such an adhesive thread layer, interesting lighting effects are produced.

According to another aspect of the invention, a fleece according to the invention can also be used in agricultural or garden areas, while the fleece is scattered in an adhesive state with certain seeds or the like. For example, grass seeds can be scattered in the necessary density, so that the final fleece can be cut with shears in order to make repairs and the like to locations on a grass surface or to lay entire grass surfaces. Such a fleece can also be used for seeds to be scattered less densely, such as those of agricultural crops, such as radishes, which require a certain planting distance from each other. In this case, the seeds are applied in a corresponding matrix or spacing pattern onto the fleece. For the purposes named above, in addition to hot-melt adhesives, primarily cold adhesives can also be used. Especially preferred are water-soluble adhesives, because then the fleece dissolves completely over time and the processing and cultivation of plants is simplified. The applications mentioned above can be adapted, however, also to such fleeces or even films made from adhesive, especially water-soluble adhesive, which are not generated with a rotary spinning head, in so far as the presented solutions are of standalone, inventive significance.

According to another aspect of the invention, a fleece according to the invention can also be used in other agricultural or garden or cultivation areas, namely as moisture dispensers. For this purpose, the not-yet-hardened fleece is scattered with certain particle-like water-holding media, such as, e.g., super-absorber particles, carob seed grain, or the like. This fleece can be shaped, e.g., so that it can be placed in a flowerpot. A plant planted in this flowerpot is then drenched very greatly with water. In this way, the water-holding medium, also called "water pad" below, fills with water. Certain super-absorbers or carob seed grain can be filled with water of ca. 500 times their volume. This water is then very slowly released to the surrounding soil or the plant. The plant can then draw moisture from this water supply very slowly without starting "to drown." As a rule, repeated procedures are possible. In this way, seedlings for plant cultivation in agricultural applications can be kept moist, e.g., in very warm areas of the world. Such a water pad can be removed completely when it is no longer needed. However, it is also possible to use a water-soluble adhesive for the adhesive thread fleece, so that this can remain in the soil, because it biologically decomposes very slowly. The applications named above can also be adapted to such fleeces or even films, which are made from adhesive, especially water-soluble adhesive, and which are not generated with a rotary spinning head. In this respect, the presented solutions are of standalone, inventive significance.

The embodiments mentioned above for material webs according to the invention and adhesive thread coatings in no way represent a conclusive listing, but instead represent currently especially preferred embodiments that can be used in many variants.

The components named above and claimed and to be used according to the invention as described in the embodiments are subject to no special exceptional conditions in terms of their size, shape, material selection, and technical design, so that they can be used without restriction in the field of application of known selection criteria.

Other details, features, and advantages of the subject matter of the invention emerge from the subordinate claims, as well as from the subsequent description of the associated drawing and table, in which—as an example, an embodiment of an application device for applying adhesive threads onto a substrate is shown.

Figure 2:
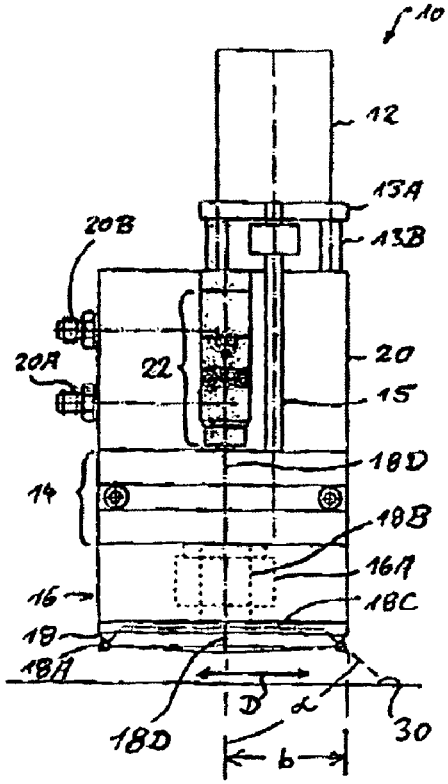
Figure 3:
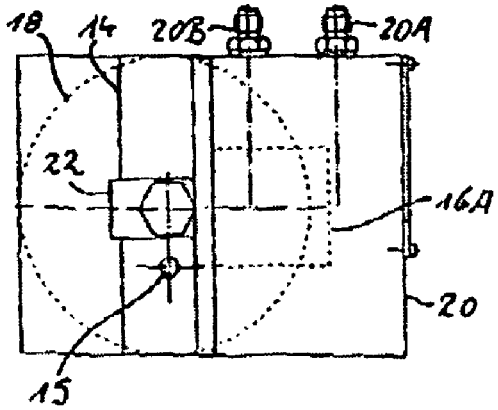
Figure 4A:
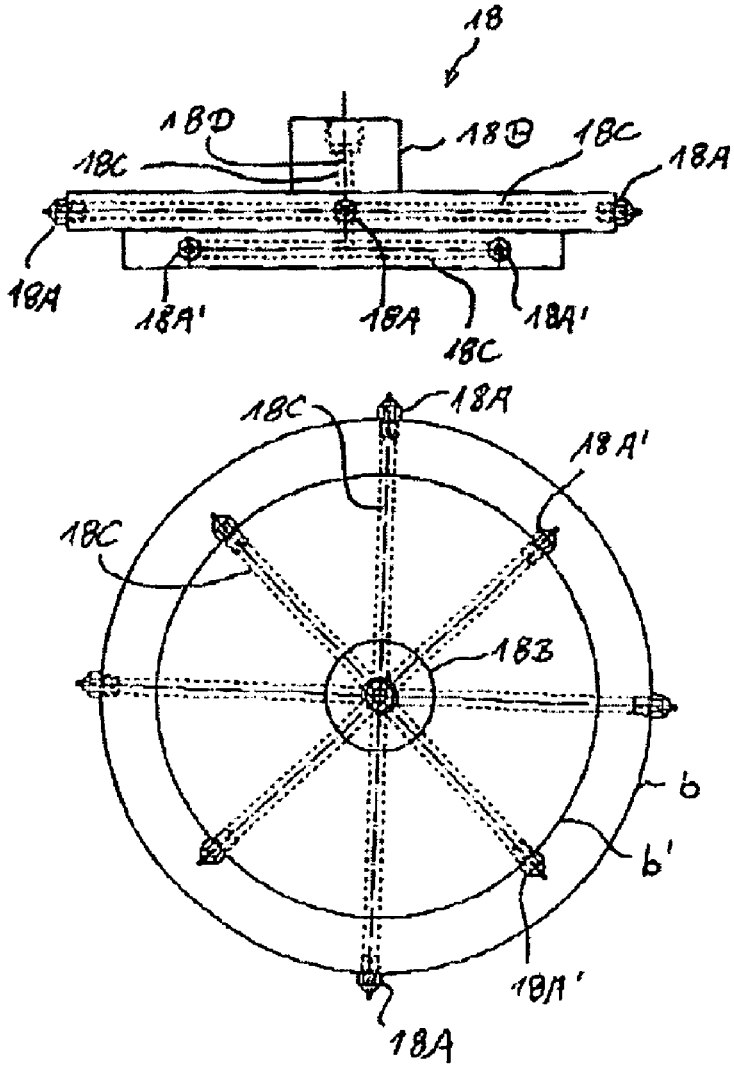
Figure 4B:
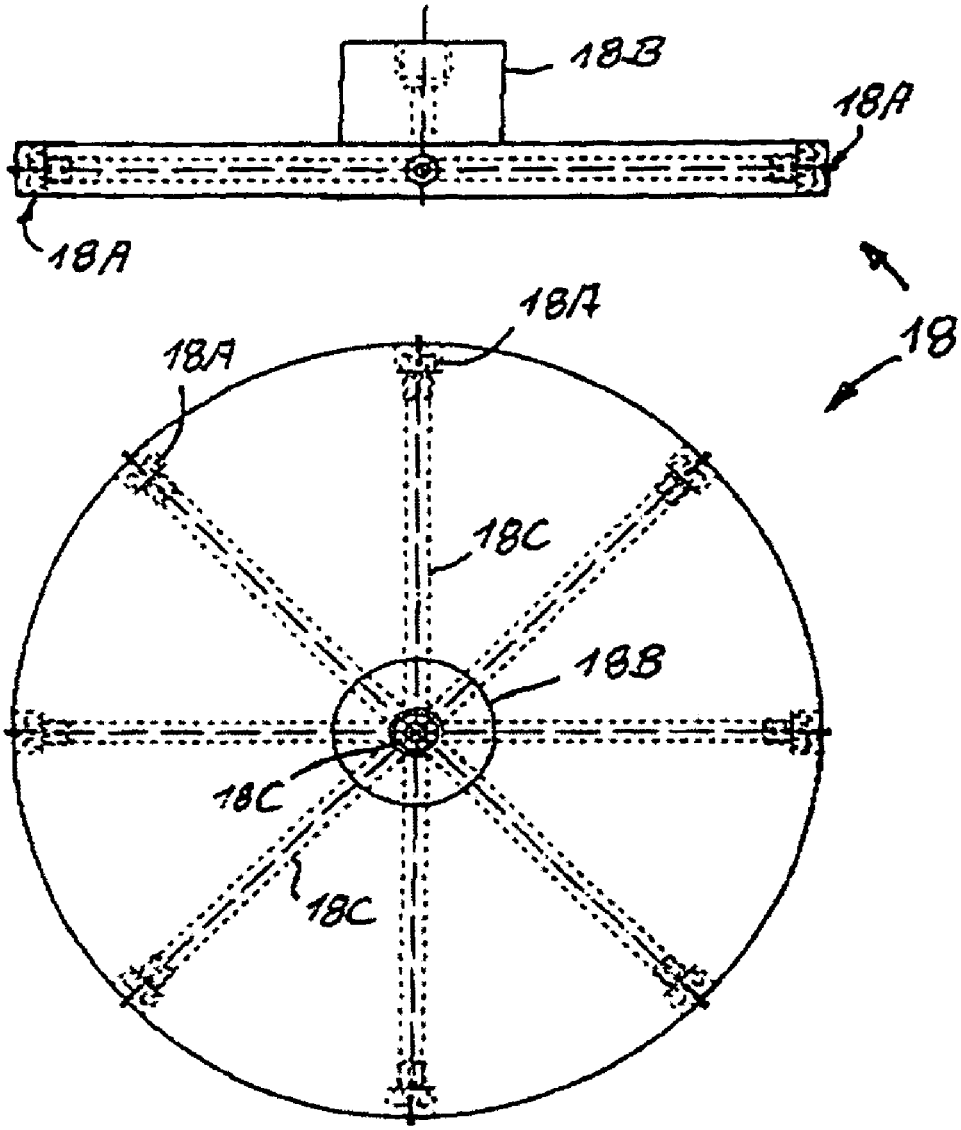
Figure 4C:
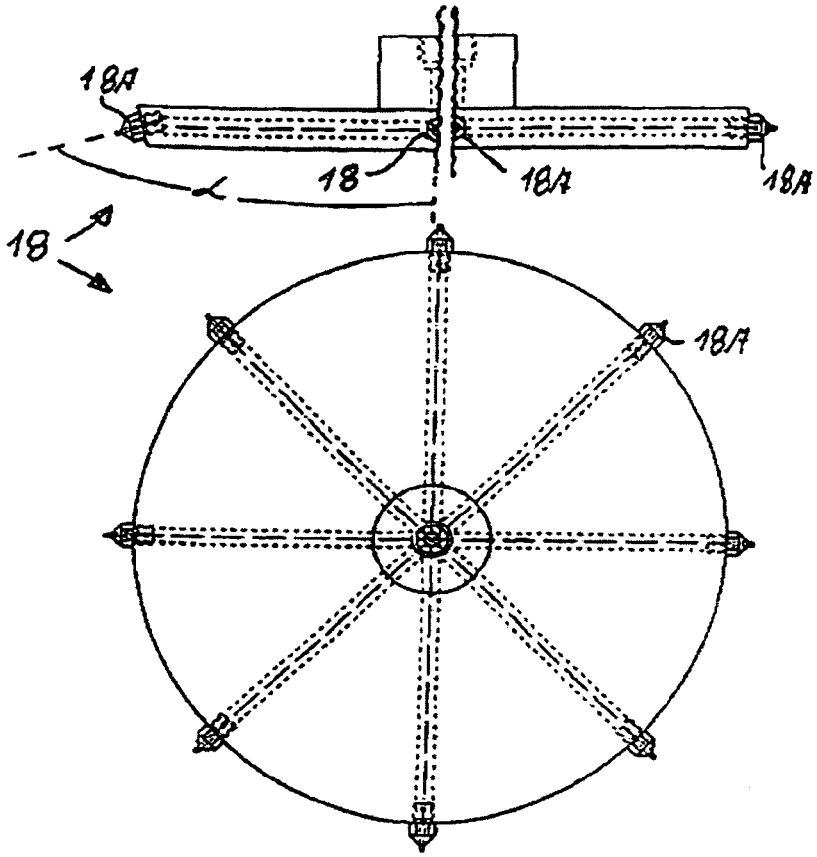
Figure 5A:
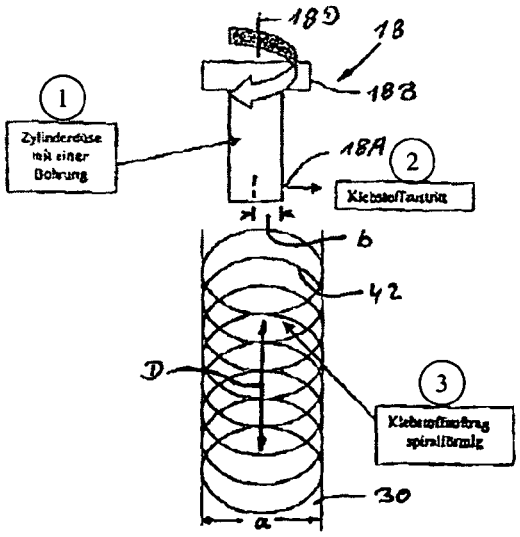
Figure 5B:
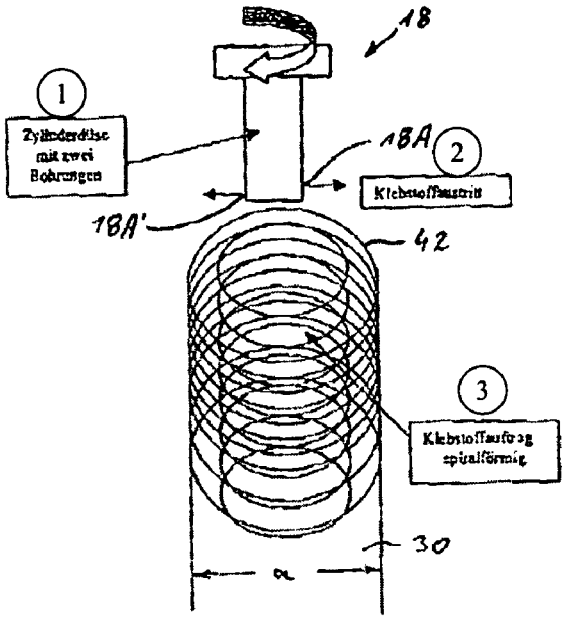
Figure 5C:
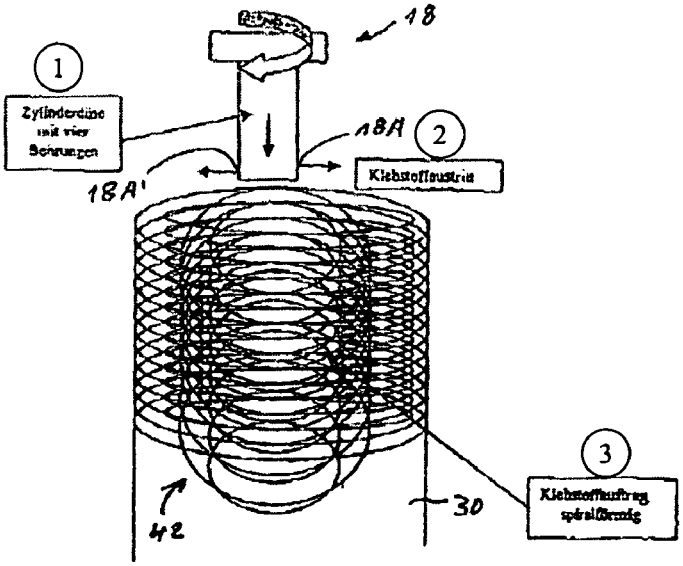
Figure 5D:
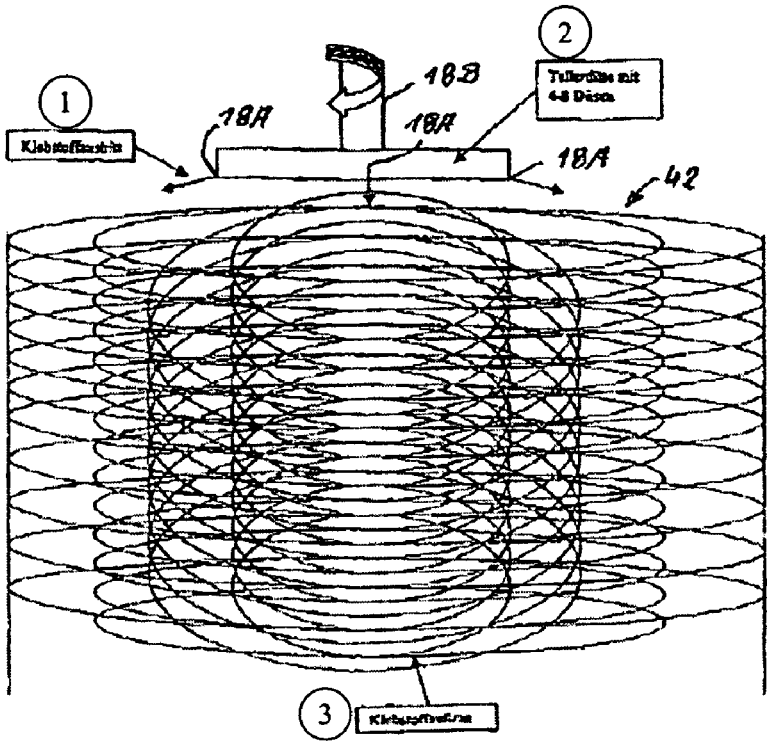
Figure 6:
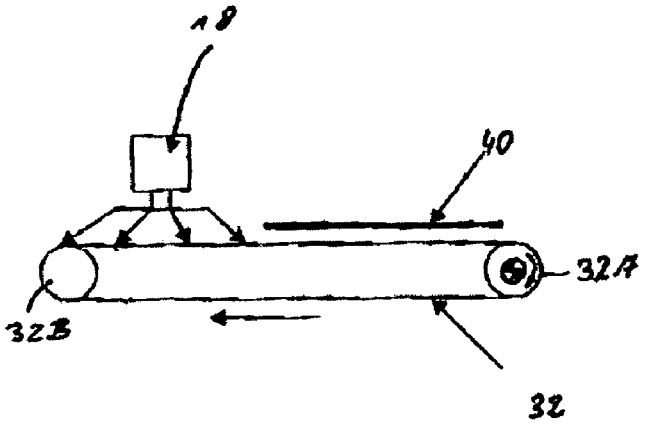

Shown in the drawing are:

FIG. 1, a device for applying adhesive threads in side view (view A-A according to FIGS. 2 and 3), FIG. 2, the same device in a side view rotated by 90° relative to FIG. 1 (view B-B according to FIGS. 2 and 3), FIG. 3, the same device in a view from above with the drive left out (view C-C according to FIGS. 1 and 2), FIGS. 4A-4C, from the same device, the rotatable application head and also other examples for alternative constructions of this same component, wherein FIG. 4A shows a stepped plate shape, FIG. 4B shows a simple plate form with countersunk nozzles, and FIG. 4C shows a simple plate form with various, suitable nozzles—each in side view and top view, FIGS. 5A-5D, schematic representations of various rotating application heads and also the thread pattern produced on the substrate, and also FIG. 6, schematic representation of a production device for an adhesive thread fleece.

As can be seen from FIGS. 1 to 3, a compact device for applying adhesive threads is made from a drive motor 12 (left out in FIG. 3), a gear 14, a heating unit 16, a rotatable application head 18, an adhesive supply unit 20, and a valve arrangement 22 for charging the adhesive application head with adhesive, such as hot-melt adhesive or cold glue.

In the shown embodiment preferred in this respect, the drive motor 12 is held by means of support means 13, like a base plate 13A and supports or spacers 13B on the top side of the housing of the adhesive supply unit 20, past which the base plate 13A projects laterally. In this way, the drive shaft 15 that can be inserted into the drive motor 12 can be guided laterally past the adhesive supply unit 20 to the gear 14. The gear 14 screwed to a side wall of the adhesive supply unit 20 has the task of transmitting the torque of the drive shaft 15 made, e.g., from solid material, to the hollow shaft shank 18B (see FIGS. 4A to 4C), so that the valve arrangement 22 can be connected coaxially in a fluid way with the shaft shank 18B of the application head 18 by means of a compacted rotary feedthrough. It is also sufficient to provide a gear transmission ratio of 1:1 and to abandon the generation of different rotational speeds of a frequency regulator of the drive motor 12 or the like. The gear 14 is otherwise closed on all sides, wherein in the embodiment a housing-shaped, three-component, dismountable gear frame is used and shown.

The heating unit 16 is arranged underneath the gear 14 and the adhesive supply unit 20 and (in this embodiment) connected to this unit, thus fixed in place. Heating units rotating with the application head can also be realized. The shown heating unit allows a passage of the shaft shank 18B and stores heating means. This can involve an infrared emitter 16A, which is arranged in a corresponding receptacle, e.g., in a position underneath the adhesive supply unit 20 and which can be supplied with electrical energy from there. Several IR heat emitters with an arrangement distributed around the shaft shank 18 or alternatively providing fluid ducts are also possible, which carry a heating fluid flow and which distribute the heat more or less uniformly over the cross section of the heating unit, especially on its bottom side. This bottom side has a smooth construction in the embodiment, so that only a small spacing gap remains on the smooth top side (reverse side) of the rotating application head 18. This spacing gap can be flushed with air of, e.g., 0.02 bar at a slight over-pressure, so that combustible or explosive powders cannot settle in this gap. Such problems could be generated in the tissue region due to the dust typically generated there and also in the coating of substrates with powdery media, e.g., activated charcoal dust.

The application heads visible from FIGS. 4A to 4C have a plate-shaped or cylindrical construction and are provided on the smooth reverse side with a hollow shaft shank 18B. The adhesive supply duct 18C beginning with the hollow shaft shank branches when several nozzles 18A are provided on the application head, by means of suitable boreholes or grooves connected to each other in a fluid way. Typical cross sections of the supply ducts lie on the order of magnitude of a few millimeters. The application head 18 can also have a multiple-component construction in order to simplify the production of adhesive supply ducts. On the bottom side of the application head facing the substrate, this head can have a flattened cone shape, such as, e.g., a pyramid or conical construction, in order to suppress the creation of a low pressure in this region as much as possible. The nozzles 18A can be mounted in an especially simple way if the plate part of the application head is handled [sic; chambered] on its periphery at the same angle at which the nozzles 18A are oriented toward the rotational axis 18D (ejection angle $\alpha$—see also FIG. 2). In the embodiment according to FIG. 4A, the application head has a plate shape with a diameter step, so that the nozzles 18A and 18A' both have planes or steps of different radial distances b and b' from the rotational axis 18D and their axial positions are also different. For this purpose, two-component or multiple-component disk arrangements can also be used.

From FIG. 4B it can be seen that the nozzles 18A can be installed countersunk into the periphery of the application head 18, so that the air turbulence generated by the nozzles is minimized.

From FIG. 4C it can be seen how nozzles can be arranged at different ejection angles on the rotary head periphery. This cannot be seen in the top view, but instead in the side view, wherein the left part of the side view shows nozzles with an ejection angle $\alpha$ of approximately 70° and the right part shows nozzles with an ejection angle of approximately 90°. On the same application head, nozzles of different ejection angles can also be provided. This leads, in turn, to the result that the adhesive threads of each nozzle generate a different application image in comparison with nozzles with other ejection angles.

While disk-shaped rotary heads were shown above, it is understood that for the purposes of the invention, annular, star-shaped, arm-shaped, or differently shaped application heads can also be used.

The adhesive supply unit 20 and the valve arrangement 22 connected to the unit by screws take over the supply of the application head 18 with the necessary amount of adhesive per unit of time including the control of the adhesive pressure and the turn-on and turn-off periods of the adhesive supply. This takes place in a known way and does not require a detailed explanation. In the shown embodiment preferred in this respect, the adhesive supply unit 20 is supplied with an adhesive supply via a feed line 20A. Non-discharged adhesive leaves the unit via a return line 20B. In certain cases, circulation of adhesive through a feed line and return line hose can be eliminated. This is the case, among other things, when standstill times happen only rarely during the coating. The desired adhesive pressure is established by means of a pump within the adhesive supply unit 20. The valve arrangement 22 can involve an open/closed valve, such that it is connected on its inlet side in a fluid way to the pressure pump of the adhesive supply unit 20 and on its outlet side to the adhesive supply duct on the input-side opening end of the shaft shank 20B. For this purpose, the free shaft shank end can be inserted into the valve arrangement on the bottom side and provided there with a rotary seal, so that the adhesive flowing out on the valve outlet side is introduced from the stationary valve into the rotating application head without leakage of adhesive.

From the above, it can be understood that the application head can have very different constructions. A plate shape is preferable in many applications but not required. As emerges from the schematic embodiments below according to FIGS. 5A to 5D, the nozzle arrangement varies according to the desired application image (adhesive thread pattern):

According to the embodiment from FIG. 5A, the application head 18 is shaped as a cylindrical nozzle with a radial borehole. It is sufficient to realize, e.g., a central borehole along the axis of the application head and a transverse borehole leading to the cylindrical periphery, wherein this transverse borehole is connected on its cylindrical outer-side outlet end to a nozzle of suitable diameter and with respect to the rotational axis 18D at suitable orientation in the radial spacing b from the rotational axis. An adhesive thread pattern that can be generated with such an application head with glue width (a) is shown schematically and as an example in FIG. 5A. In principle, the adhesive thread track generated on the substrate 30 is circular, wherein the size of the circle diameter and the thread thickness depend on the parameters described above. Therefore, because the substrate 30 and the application head 18 are moved relative to each other (double-headed arrow D), a spiral shape is formed from the circular adhesive track. The glue width a results from the diameter of the adhesive track.

A more complex embodiment is shown in FIG. 5B. Here, two circular or spiral adhesive tracks of different diameters are to be applied on the substrate 30. For this purpose, according to the embodiment, in turn, a cylindrical nozzle—but now with two radial boreholes—is provided. Each is connected in a fluid way to the central supply borehole, in order to generate by means of one nozzle 18A an adhesive track with a different diameter than the other nozzle 18A' generates. As mentioned above, different paths can be followed, e.g., forming the radial boreholes leading to the two nozzles in different axial lengths relative to the central borehole of the shaft shank 18B. In this way, in the embodiment according to FIG. 5B, an adhesive track of greater diameter is generated by the nozzle 18A than by the nozzle 18A', when otherwise the same relationships are provided on the nozzles. However, it is also possible to select the nozzle cross section and/or the ejection angle α of the two nozzles to be different in order to let each of the nozzles generate a different application image.

In the embodiment according to FIG. 5C, four nozzles 18A, 18A' distributed on the periphery on a cylindrical application head 18 are provided with a radial spacing of their outlet opening from the rotational axis 18D, so that four different application patterns overlap on the substrate 30. In the embodiment according to FIG. 5D, four to eight nozzles are used, wherein the application head 18 has a plate shape and the nozzles are provided for different size ejection widths, so that, e.g., the adhesive thread pattern shown in FIG. 5D is produced on the substrate 30.

From the schematic representation of a production installation of an adhesive thread fleece according to FIG. 6, a transport belt 32 can be seen, which is guided around two deflection rollers 32A, 32B as an endless belt, where at least one roller is driven to rotate. The transport belt has an anti-slip coating on its surface pointing outward in a suitable way and is driven at a given speed. The application head 18 is located in the upstream zone of the transport belt with a spacing above its top belt section, so that it applies an adhesive thread layer of desired width and density with a single application head or optionally additional application heads directly onto the transport belt advancing underneath. In this way an adhesive thread fleece 40 is produced, which can be lifted from the transport belt 32 at the downstream end of the optionally cooled transport section and processed further, e.g., by winding up to form a coil or also for application onto a substrate for lamination purposes in a heated double-roller gap. Intermediate storage devices known in textile technology in the shape of movable deflection rollers also permit discontinuous lamination.

Explanation of Symbols

10 Application device
12 Drive motor
13 Support means
13A Base plate
13B Support
14 Gear
15 Drive shaft
16 Heating unit
16A IR heat emitter
18 Application head
18A Nozzle
18B Shaft shank
18C Adhesive supply duct
18D Rotational axis
20 Adhesive supply unit
20A Feed line
20B Return line
22 Valve arrangement
30 Substrate
32 Transport belt
32A/B Deflection rollers
40 Adhesive thread fleece
42 Adhesive thread surfaces
A View
B View
C View
D Double-headed arrow
α Ejection angle
a Glue width
b Radial distance

The invention claimed is:

1. An adhesive applying method for applying adhesive threads onto a substrate comprising the steps of pressing a still fluid adhesive through rotating adhesive outlet nozzles being provided in an application head and being spaced radially apart from the rotational axis and ejecting the fluid adhesive out of the outlet nozzles as an adhesive thread in an approximately circular motion onto a substrate without applying disruptive spraying air, said application head being relatively moved with respect to and above said substrate, and wherein centrifugal forces act on the emerging adhesive thread and wherein at least two of said rotating adhesive outlet nozzles generate different application images.

2. The adhesive applying method according to claim 1, wherein a substance is applied to at least one of an adhesive thread fleece and an adhesive thread layer being established on said substrate so as to bond the substance to the adhesive threads.

3. The adhesive applying method according to claim 2, wherein the substance includes particles.

4. The adhesive applying method according to claim 3, wherein absorbent particles including at least one of activated charcoal particles, moisture-absorbing particles and an optical indicator are arranged on or in the adhesive threads.

5. The adhesive applying method according to claim 2, wherein absorbent particles including at least one of activated charcoal particles, moisture-absorbing particles and an optical indicator are arranged on or in the adhesive threads.

6. The adhesive applying method according to claim 1, wherein absorbent particles including at least one of activated charcoal particles, moisture-absorbing particles and an optical indicator are arranged on or in the adhesive threads.

7. The adhesive applying method according to claim 6 wherein an adhesive thread fleece is made and is at least one of being made from a cold adhesive and being water-soluble.

8. The adhesive applying method according to claim 1 wherein an adhesive thread fleece is made and is at least one of being made from a cold adhesive and being water-soluble.

9. The adhesive applying method according to claim 8, wherein at least one of the adhesive thread fleece and an adhesive thread layer is constructed as one of a perforated film, a non-perforated film and a three-dimensionally shaped component.

10. The adhesive applying method according to claim 1 wherein the different application images includes point-like shapes.

11. The adhesive applying method according to claim 1, wherein the adhesive thread layer is utilized in as at least one of:

- an activated charcoal filter with or without a carrier substrate;
- a hygienic article including a diaper, a slip insert, with a carrier substrate;
- a hygienic article including a diaper, a slip insert, without a carrier substrate;
- a technical textile material for protective clothing and the like, made from a textile substrate and at least one of an adhesive thread fleece and an adhesive thread layer;
- a web-shaped packaging material for at least one of packing individual parts and as an inner linings of packaging boxes with a carrier substrate;
- a web-shaped packaging material for at least one of packing individual parts and as an inner linings of packaging boxes without a carrier substrate;
- an insulating mat, especially floor step insulating mats, made from at least one of an insulating mat, an adhesive thread fleece and an adhesive thread layer;
- a covering film as moisture protection, including roof covering webs having an anti-slip coat in form of at least one of an adhesive thread fleece and the adhesive thread layer;
- a web-shaped decoration material, with a carrier substrate;
- a web-shaped decoration material, without a carrier substrate;
- a seed planting substrate; and,
- a moisture-releasing adhesive thread fleece wherein at least one of super-absorber particles, carob seed grain, and other particle-like water-storage mediums bond to the fleece.

12. The adhesive applying method according to claim 1 wherein the different application images includes circles of different diameters.

13. An adhesive applying method for applying adhesive threads onto a substrate comprising the steps of providing an application head that is rotatable about a head rotation axis, providing a first group of adhesive outlet nozzles on the application head and spaced radially from the head rotational axis, providing a second group of adhesive outlet nozzles on the application head and spaced radially from the head rotational axis, pressing a fluid adhesive through the first and second groups of adhesive outlet nozzles thereby ejecting the fluid adhesive out of the first and second groups of outlet nozzles as adhesive threads onto a substrate without applying disruptive spraying air, selectively rotating the application head about the head rotation axis and relative to the substrate wherein centrifugal forces produced by the rotation of the application head act on the emerging adhesive thread from the first and second groups of adhesive outlet nozzles, the adhesive threads from the first group of adhesive outlet nozzles producing a first application image on the substrate and the adhesive threads from the second group of adhesive outlet nozzles producing a second application image on the substrate, the first and second application images being different images.

14. The adhesive applying method according to claim 13 wherein the application head is a first application head and the method further including the step of providing a second application head, the first group of adhesive outlet nozzles being on the first application head and the second group of adhesive outlet nozzles being on the second application head.

15. The adhesive applying method according to claim 13 wherein at least one of the first and second application images includes point-like shapes.

16. The adhesive applying method according to claim 13 wherein the first group of adhesive outlet nozzles are spaced radially from the head rotational axis a first radial spacing and the second group of adhesive outlet nozzles are spaced from the head rotational axis a second radial spacing, the first and second radial spacings being unequal.

17. The adhesive applying method according to claim 16 wherein the first group of adhesive outlet nozzles is oriented in a first plane generally transverse to the head rotational axis and the second group of adhesive outlet nozzles is oriented in a second plane transverse to the head rotational axis, the first and second planes being spaced from one another.

18. The adhesive applying method according to claim 16 wherein the first application image include circles of a first diameter and the second application image includes circles of a second diameter.

19. The adhesive applying method according to claim 13 wherein the first group of adhesive outlet nozzles is oriented in a first plane generally transverse to the head rotational axis and the second group of adhesive outlet nozzles is oriented in a second plane transverse to the head rotational axis, the first and second planes being spaced from one another.

20. The adhesive applying method according to claim 13 wherein the first group of adhesive outlet nozzles are oriented from the head rotational axis at a first ejector angle and the second group of adhesive outlet nozzles are oriented from the head rotational axis at a second ejector angle, the first and second ejector angles being unequal.

21. The adhesive applying method according to claim 13 further including the steps of providing a third group of adhesive outlet nozzles on the application head, the adhesive threads from the third group of adhesive outlet nozzles producing a third application image on the substrate.

* * * * *

UNITED STATES PATENT AND TRADEMARK OFFICE

CERTIFICATE OF CORRECTION

PATENT NO. : 8,323,730 B2
APPLICATION NO. : 11/992636
DATED : December 4, 2012
INVENTOR(S) : Michael Brune et al.

It is certified that error appears in the above-identified patent and that said Letters Patent is hereby corrected as shown below:

On the Title page in the Title, Section [54], Line 2, delete "THERADS" and insert --THREADS--.

Signed and Sealed this
Twelfth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,323,730 B2
APPLICATION NO. : 11/992636
DATED : December 4, 2012
INVENTOR(S) : Michael Brune et al.

It is certified that error appears in the above-identified patent and that said Letters Patent is hereby corrected as shown below:

On the Title page Item [54], Line 2 and at Column 1, Line 2 delete "THERADS" and insert --THREADS--.

This certificate supersedes the Certificate of Correction issued February 12, 2013.

Signed and Sealed this
Nineteenth Day of March, 2013

Teresa Stanek Rea
*Acting Director of the United States Patent and Trademark Office*